US007950734B2

(12) United States Patent
Zheng

(10) Patent No.: US 7,950,734 B2
(45) Date of Patent: May 31, 2011

(54) RECLINER WITH LOCKING MECHANISM

(76) Inventor: Edward Zheng, La Verne, CA (US)

( * ) Notice: Subject to any disclaimer, the term of this patent is extended or adjusted under 35 U.S.C. 154(b) by 312 days.

(21) Appl. No.: 12/284,304

(22) Filed: Sep. 18, 2008

(65) Prior Publication Data

US 2009/0072592 A1 Mar. 19, 2009

Related U.S. Application Data

(60) Provisional application No. 60/994,456, filed on Sep. 18, 2007.

(51) Int. Cl.
*A47C 4/00* (2006.01)

(52) U.S. Cl. ..... 297/28; 297/27; 297/359

(58) Field of Classification Search ..... 297/27, 297/28, 359, 360

See application file for complete search history.

(56) References Cited

U.S. PATENT DOCUMENTS 478,247 A * 7/1892 Valentine ..... 297/359
715,388 A * 12/1902 Kenny ..... 297/319
1,970,480 A * 8/1934 Wood ..... 297/359
2,099,460 A * 11/1937 Bell ..... 297/365
2,195,091 A * 3/1940 Lorenz et al. ..... 297/27
2,649,138 A * 8/1953 Rechler ..... 297/21
2,865,431 A * 12/1958 Ruaud et al. ..... 297/27
4,072,341 A * 2/1978 Kurz ..... 297/27
4,596,484 A * 6/1986 Nakatani ..... 403/104
5,464,270 A * 11/1995 Chang ..... 297/81
5,570,926 A * 11/1996 Papiernik et al. ..... 297/39
6,030,032 A * 2/2000 Tseng ..... 297/38
6,142,699 A * 11/2000 Pao ..... 403/109.5
6,296,304 B1 * 10/2001 Zheng ..... 297/45
6,755,463 B2 * 6/2004 Lardieri et al. ..... 297/35
D532,621 S * 11/2006 Lin ..... D6/368
7,185,948 B2 * 3/2007 Liu ..... 297/30
7,243,990 B1 * 7/2007 Wahl ..... 297/184.15
D556,468 S * 12/2007 Le Gal et al. ..... D6/368
7,500,715 B1 * 3/2009 Chen ..... 297/27
7,628,450 B2 * 12/2009 Castagnola et al. ..... 297/38
2002/0125745 A1 * 9/2002 Lee ..... 297/30

* cited by examiner

*Primary Examiner* — David Dunn
*Assistant Examiner* — David E Allred
(74) *Attorney, Agent, or Firm* — Raymond Y. Chan; David and Raymond Patent Firm

(57) ABSTRACT

A recliner includes a folding frame including two arm rests, a chair frame coupling with the folding frame, and a locking mechanism. The chair frame includes a seat frame, a back frame, and a leg frame, wherein the chair frame is adapted to be selectively adjusted an inclination angle thereof to adjust the corresponding position of each of the seat frame, the back frame, and the leg frame in responsive to the sliding movement of the arm rest. The locking mechanism is provided at a bottom side of each of the arm rests to lock up the chair frame at the inclination angle.

20 Claims, 10 Drawing Sheets

RECLINER WITH LOCKING MECHANISM

CROSS REFERENCE OF RELATED APPLICATION

This is a non-provisional application of a provisional application having an application No. 60/994,456 and a filing date of Sep. 18, 2007.

BACKGROUND OF THE PRESENT INVENTION

1. Field of Invention

The present invention relates to a recliner, and more particular to a recliner with a locking mechanism, wherein the user is able to selectively adjust an inclination angle of the recliner and to lock up the recliner at the optimum inclination angle via the locking mechanism.

2. Description of Related Arts

A conventional recliner generally comprises a supporting frame supporting a chair frame thereat, wherein the chair frame comprises a seat rest, a backrest, and a footrest. A sitter is able to sit on the recliner to lower the backrest and to raise the footrest. However, the conventional recliner has several drawbacks.

The conventional recliner is an armchair having a bulky size to support the weight of the sitter and to provide a stable reclining movement of the recliner. Therefore, the conventional recliner cannot be moved from one place to another place.

An improved recliner is incorporated with a foldable frame to support the chair frame. However, the foldable frame cannot rigidly provide the relining movement of the recliner. In other words, the foldable frame must be configured strong enough to support the chair frame when the sitter sits thereon.

In addition, the conventional recliner can only be adjusted between its upright position and its inclined position.

SUMMARY OF THE PRESENT INVENTION

A main object of the present invention is to provide a recliner with a locking mechanism, wherein the user is able to selectively adjust an inclination angle of the recliner and to lock up the recliner at the optimum inclination angle via the locking mechanism.

Another object of the present invention is to provide a recliner with a locking mechanism, wherein the locking mechanism is provided at the bottom side of each of the arm rests such that the user is able to easily reach the locking mechanism for locking/unlocking operation.

Another object of the present invention is to provide a recliner with a locking mechanism, wherein the user is able to apply a mild upward force at the leg frame by the legs of the user and a mild downward force at the back frame by the body of the user to adjust the inclination angle of the recliner. Therefore, the user is able to securely grip at the arm rest to operate the locking mechanism.

Another object of the present invention is to provide a recliner with a locking mechanism, wherein the hands of the user will remain resting on the arm rests during the angle adjusting operation such that the user is able to safely and stably fold the recliner.

Another object of the present invention is to provide a recliner with a locking mechanism, wherein the recliner can be folded into a compact size for storage and carriage and locked up by the locking mechanism.

Another object of the present invention is to provide a recliner with a locking mechanism, wherein the folding frame is rigid enough to support the weight of the user and to provide a stable reclining movement of the recliner. Therefore, the recliner can be folded into a compact size and can be unfolded for the user to sit on the recliner.

Another object of the present invention is to provide a recliner with a locking mechanism, wherein no expensive or complicated structure is required to employ in the present invention in order to achieve the above mentioned objects. Therefore, the present invention successfully provides an economic and efficient solution for providing a rigid configuration for the recliner to safely and stably adjust the inclination angle of the recliner.

Accordingly, in order to accomplish the above objects, the present invention provides a recliner, comprising:

a folding frame comprising two arm rests;

a chair frame, which is coupled with the folding frame, comprising a seat frame, a back frame, and a leg frame, wherein the chair frame is adapted to be selectively adjusted an inclination angle thereof to adjust the corresponding position of each of the seat frame, the back frame, and the leg frame; and a locking mechanism provided at a bottom side of each of the arm rests to lock up the chair frame at the inclination angle.

These and other objectives, features, and advantages of the present invention will become apparent from the following detailed description, the accompanying drawings, and the appended claims.

DETAILED DESCRIPTION OF THE PREFERRED EMBODIMENT

Figure 1:
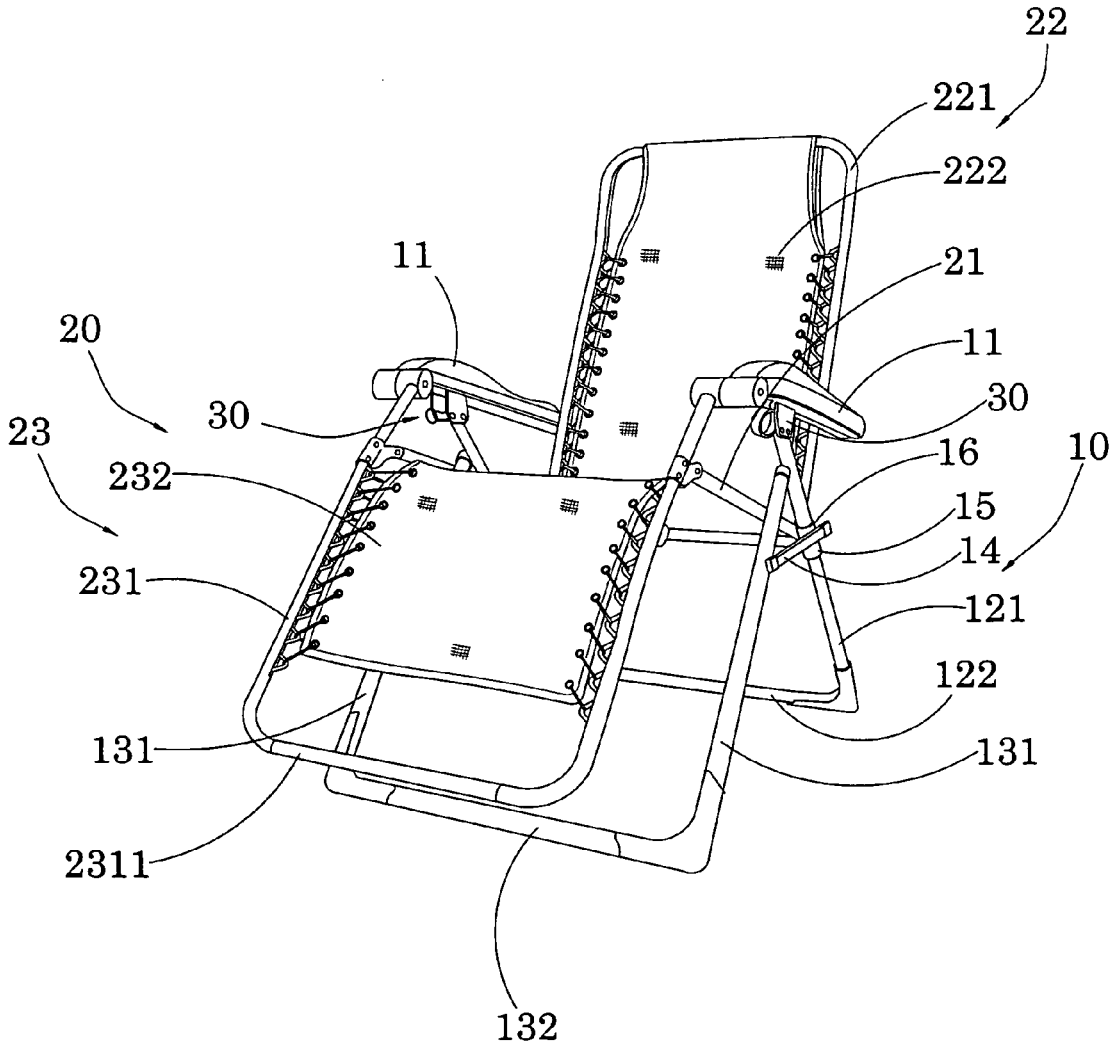
FIG. 1 is a perspective view of a recliner at an unfolded position according to a preferred embodiment of the present invention.
Figure 3:
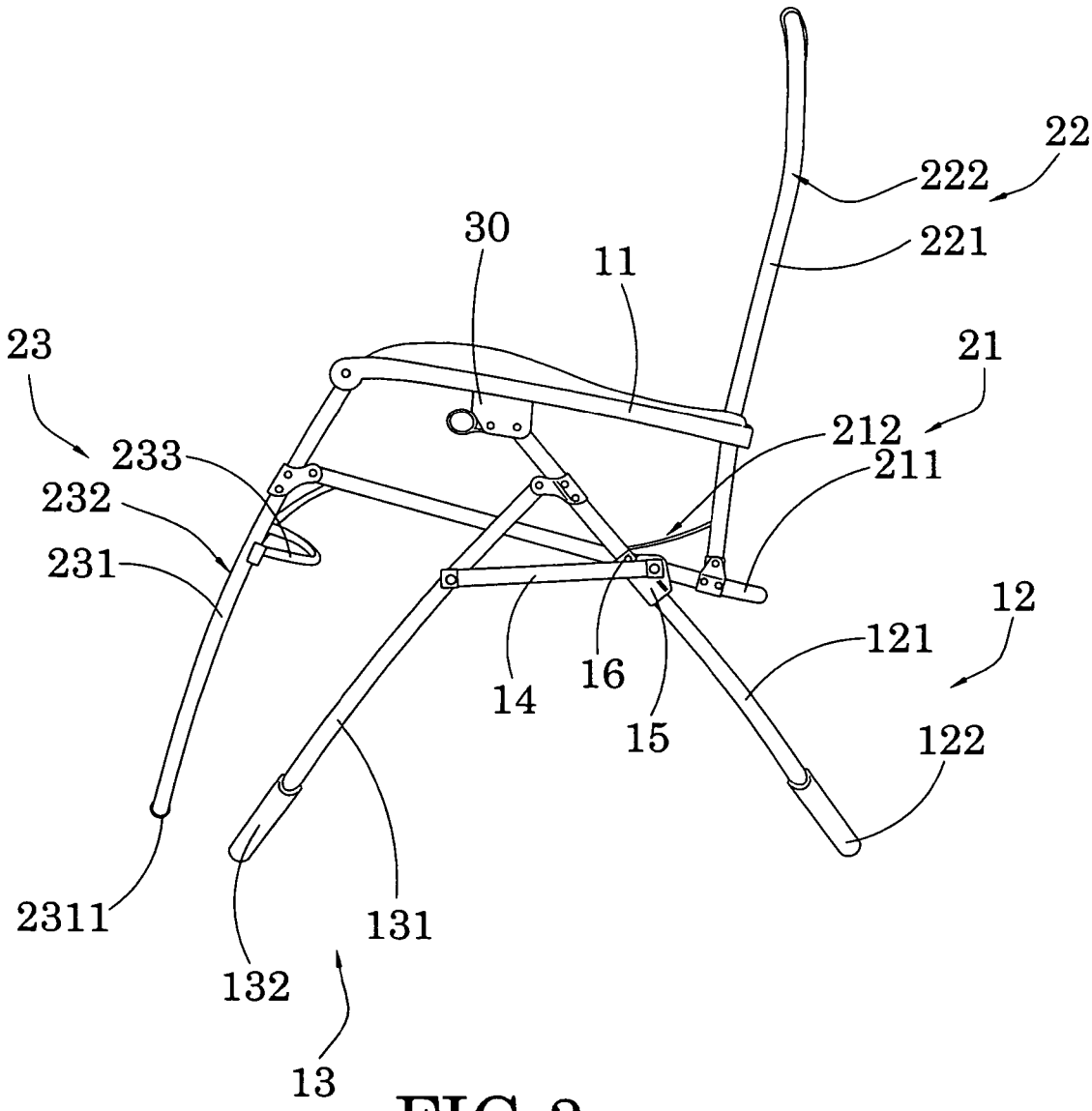
FIG. 3 is a side view of the recliner according to the above preferred embodiment of the present invention, illustrating the chair frame being unfolded at an upright position.
Figure 4:
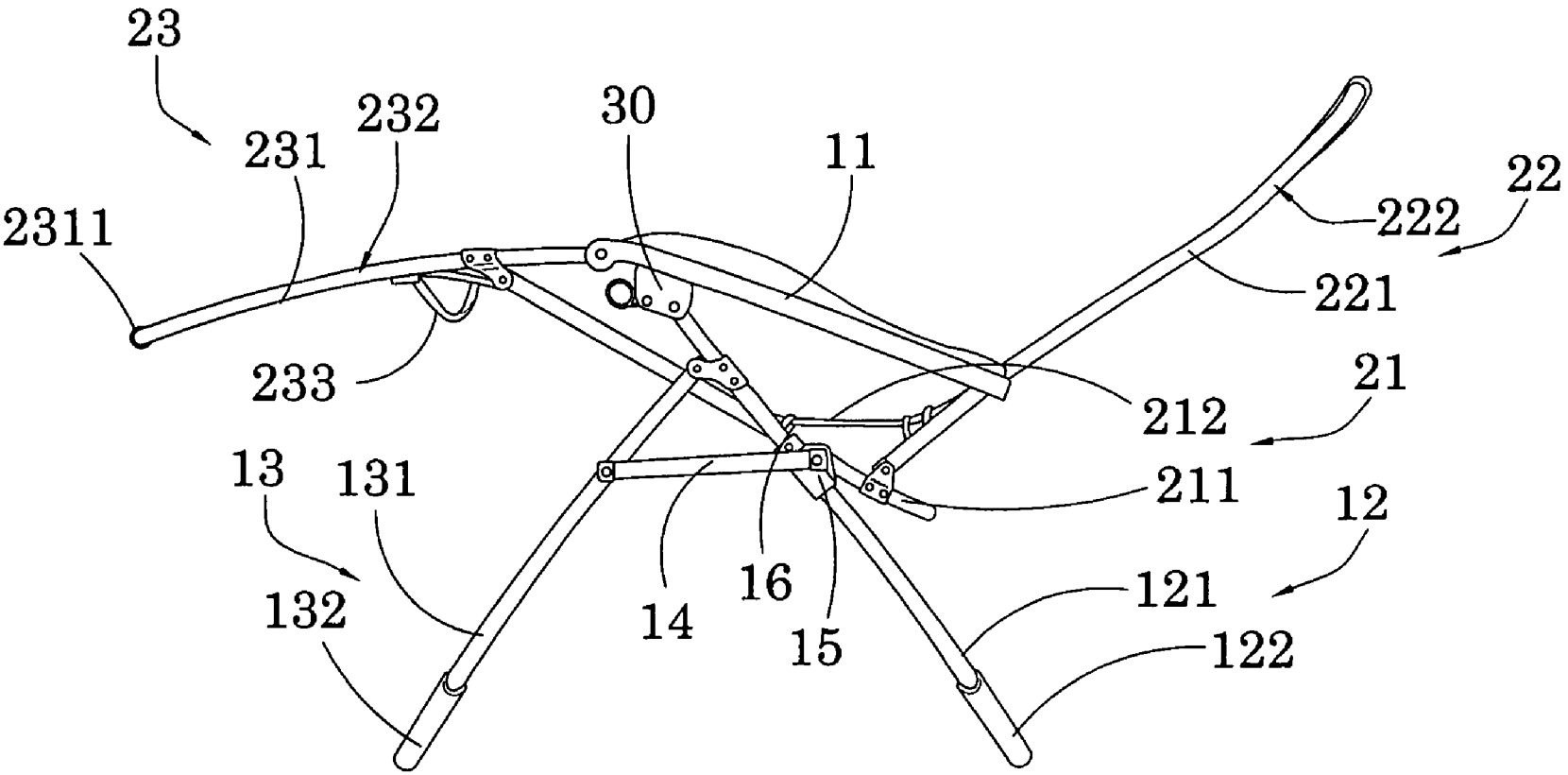
FIG. 4 is a side view of the recliner according to the above preferred embodiment of the present invention, illustrating the chair frame being unfolded at a lying position.

Referring to FIGS. 1, 3 and 4 of the drawings, a recliner according to a preferred embodiment of the present invention is illustrated, wherein the recliner comprises a folding frame 10 and a chair frame 20.

The folding frame 10 comprises two elongated arm rests 11, a U-shaped rear leg frame 12, and a U-shaped front leg frame 13. The rear leg frame 12 has two rear supporting legs 121 extending upwardly and a horizontal rear ground leg 122 to form the U-shaped structure. The front leg frame 13 has two front supporting legs 131 extending upwardly and a horizontal front ground leg 132 to form the U-shaped structure.

Two ends of the rear leg frame 12 are slidably coupled with the arm rests 11 respectively. Two ends of the front leg frame 13 are pivotally coupled with rear supporting legs 121 of the rear leg frame 12 respectively. Therefore, the front and rear leg frames 13, 12 are adapted to pivotally fold between an unfolded position and a folded position.

Accordingly, at the unfolded position, as shown in FIGS. 1, 3, and 4, the front leg frame 13 is pivotally folded at a position that the front ground leg 132 is moved away from the rear ground leg 122 to maximize a distance between front ground leg 132 and the rear ground leg 122 such that the front and rear leg frames 13, 12 form an inverse V-structure. In other words, each of the front supporting legs 131 is inclindedly extended from the corresponding rear supporting leg 121 at a usage angle.

Figure 2:
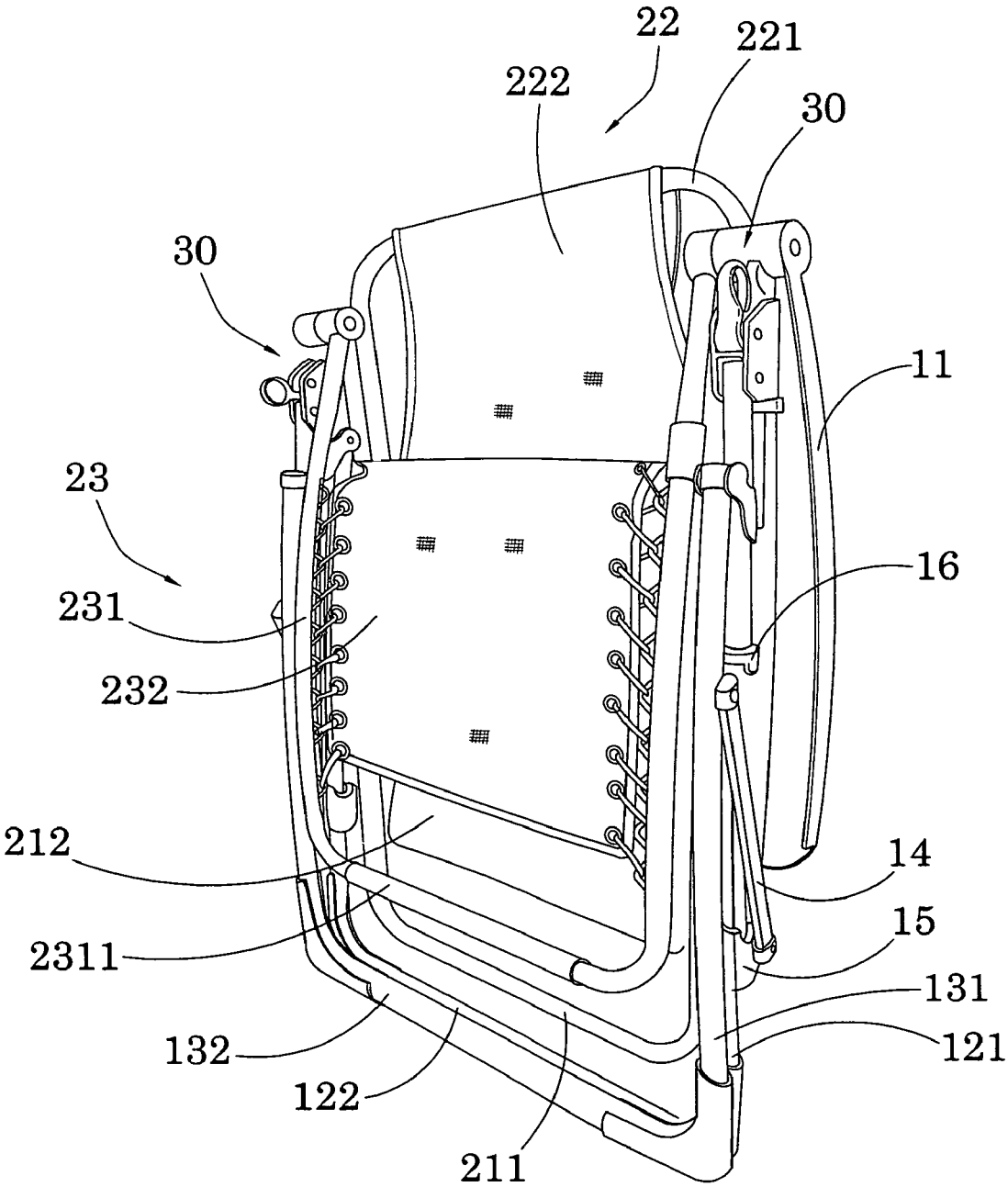
FIG. 2 is a perspective view of the recliner at a folded position according to the above preferred embodiment of the present invention.

At the folded position, as shown in FIG. 2, the front leg frame 13 is pivotally folded towards the rear leg frame 12 at a position that the front supporting legs 131 are overlapped with the rear supporting legs 121 respectively to minimize a distance between front ground leg 132 and the rear ground leg 122.

The folding frame 10 further comprises two retention arms 14 coupled with the front and rear leg frames 13, 12. Each of the retention arms 14 has a pivot end pivotally coupled with the front supporting leg 131 and a sliding end slidably coupled with the rear supporting leg 121. Two sliding joints 15 are slidably coupled at the rear supporting legs 121 respectively, wherein the sliding ends of the retention arms 14 are pivotally coupled with the sliding joints 15 respectively. In other words, the retention arms 14 are pivotally and slidably coupled with the rear supporting legs 121 respectively.

Each of the sliding joints 15 has a tubular sleeve, wherein the respective rear supporting leg 121 is slidably extended through the tubular sleeve of the sliding joint 15, wherein the sliding end of the retention arm 14 is pivotally coupled with the outer wall of the tubular sleeve of the sliding joint 15. The folding frame 10 further comprises two stoppers 16 mounted at the rear supporting legs 121 respectively at a position above the sliding joints 15 such that when the sliding joints 15 upwardly slide along the rear supporting legs 121 respectively, the sliding joints 15 are blocked by the stoppers 16 respectively to block the further sliding movement of the sliding joints 15.

Accordingly, the retention arms 14 are used for limiting the usage angle between the front and rear leg frames 13, 12 by the lengths of the retention arms 14. When the sliding joints 15 are blocked by the stoppers 16 respectively, the retention arms 14 restrict the pivotal movement of the front leg frame 13 such that the retention arms 14 retain the front and rear leg frames 13, 12 at the unfolded position.

The chair frame 20, according to the preferred embodiment, comprises a seat supporting frame 21 pivotally coupled with the folding frame 10, a back supporting frame 22 pivotally coupled with the seat supporting frame 21, and a leg supporting frame 23 pivotally coupled with the seat supporting frame 21.

Figure 5:
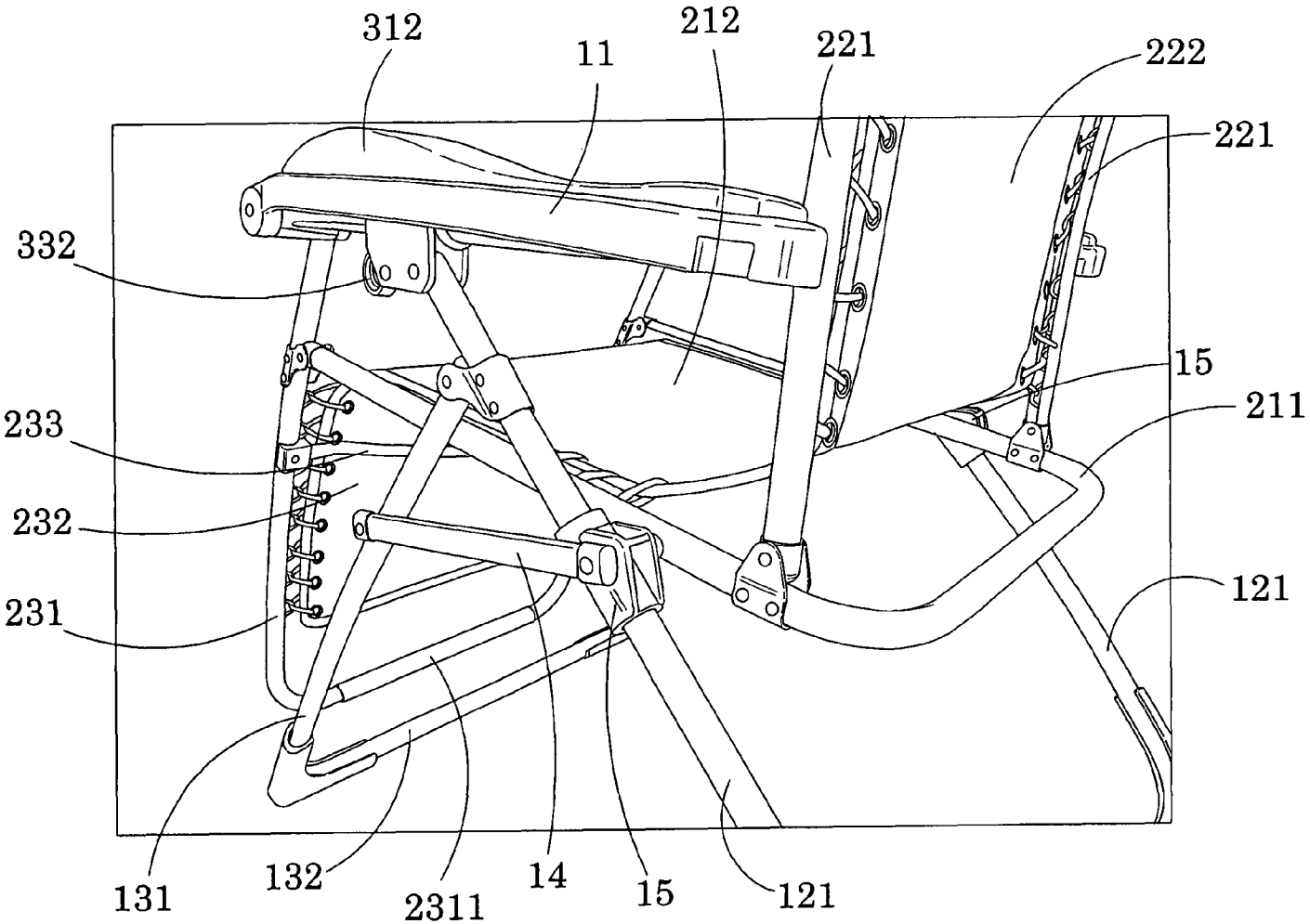
FIG. 5 is a perspective view of the seat supporting frame according to the above preferred embodiment of the present invention.

As shown in FIG. 5, the seat supporting frame 21 comprises a U-shaped seat arm 211 and a seat panel 212 mounted to the seat arm 211, wherein two ends of the seat arm 11 are extended frontwardly. Two side portions of the seat arm 211 are pivotally coupled with the sliding joints 15 respectively such that when the sliding joints 15 are slid along the rear supporting legs 121, the seat arm 211 is correspondingly folded in a pivotally movable manner. The seat panel 212 comprises a seat fabric panel mounted between the two side portions of the seat arm 211 for a user sitting on the seat panel 212.

Figure 6:
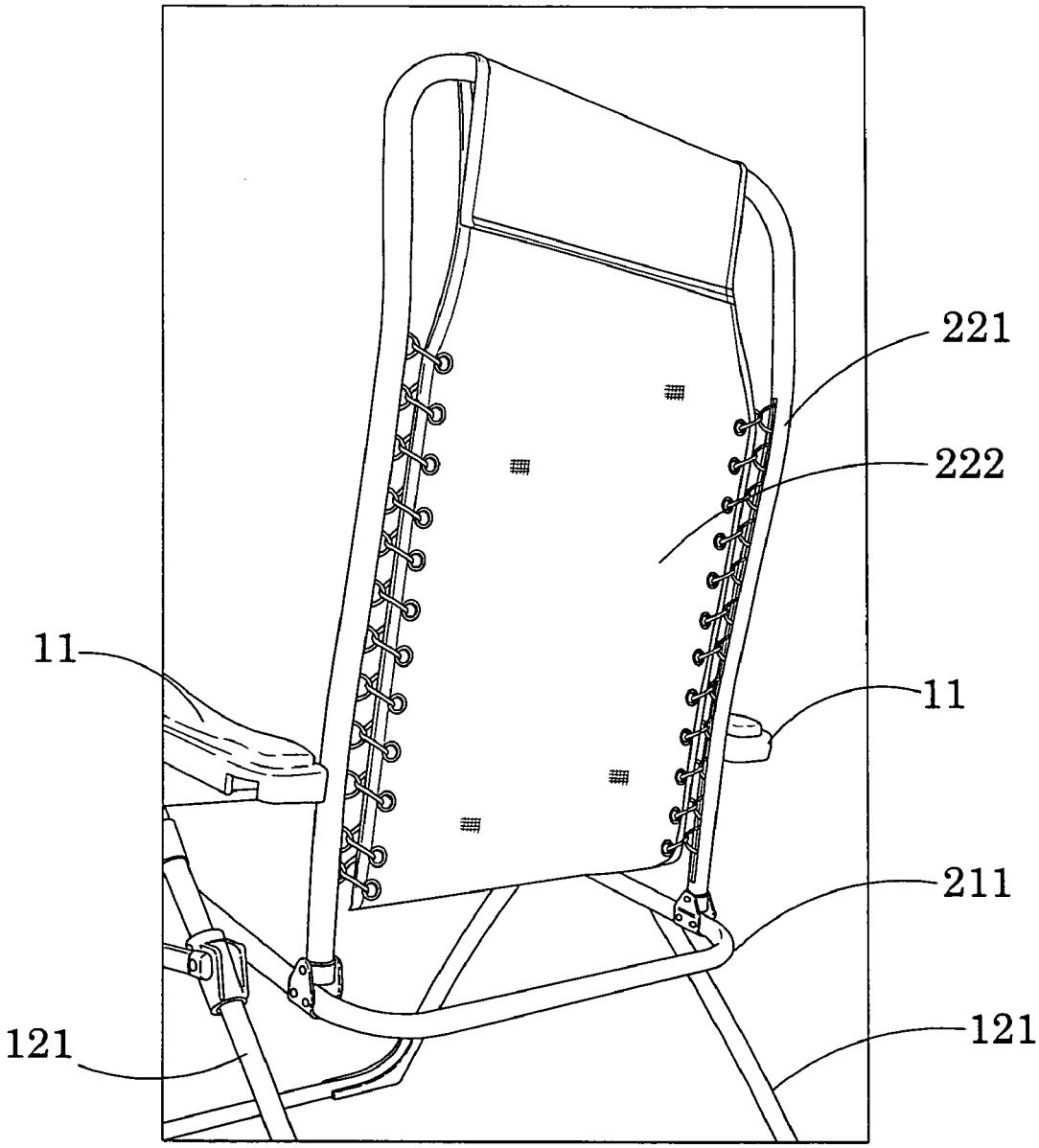
FIG. 6 is a perspective view of the back supporting frame according to the above preferred embodiment of the present invention.

As shown in FIG. 6, the back supporting frame 22 comprises an inverse U-shaped back arm 221 and a back panel 222 mounted to the back arm 221, wherein two ends of the back arm 221 are extended downwardly. The two ends of the back arm 221 are pivotally coupled with the side portions of the seat arm 211 respectively such that the back supporting frame 22 is pivotally coupled with the seat supporting frame 21 to selectively adjust an inclination angle between the seat supporting frame 21 and the supporting back frame 22. In addition, two rear ends of the arm rests 11 are pivotally coupled with the side portions of the back arm 221. The back panel 222 comprises a back fabric panel mounted between the two side portions of the back arm 221 for supporting the user's back at the back panel 222. Accordingly, the seat panel 221 is integrally extended from the back panel 222 to form a one piece fabric structure.

Figure 7:
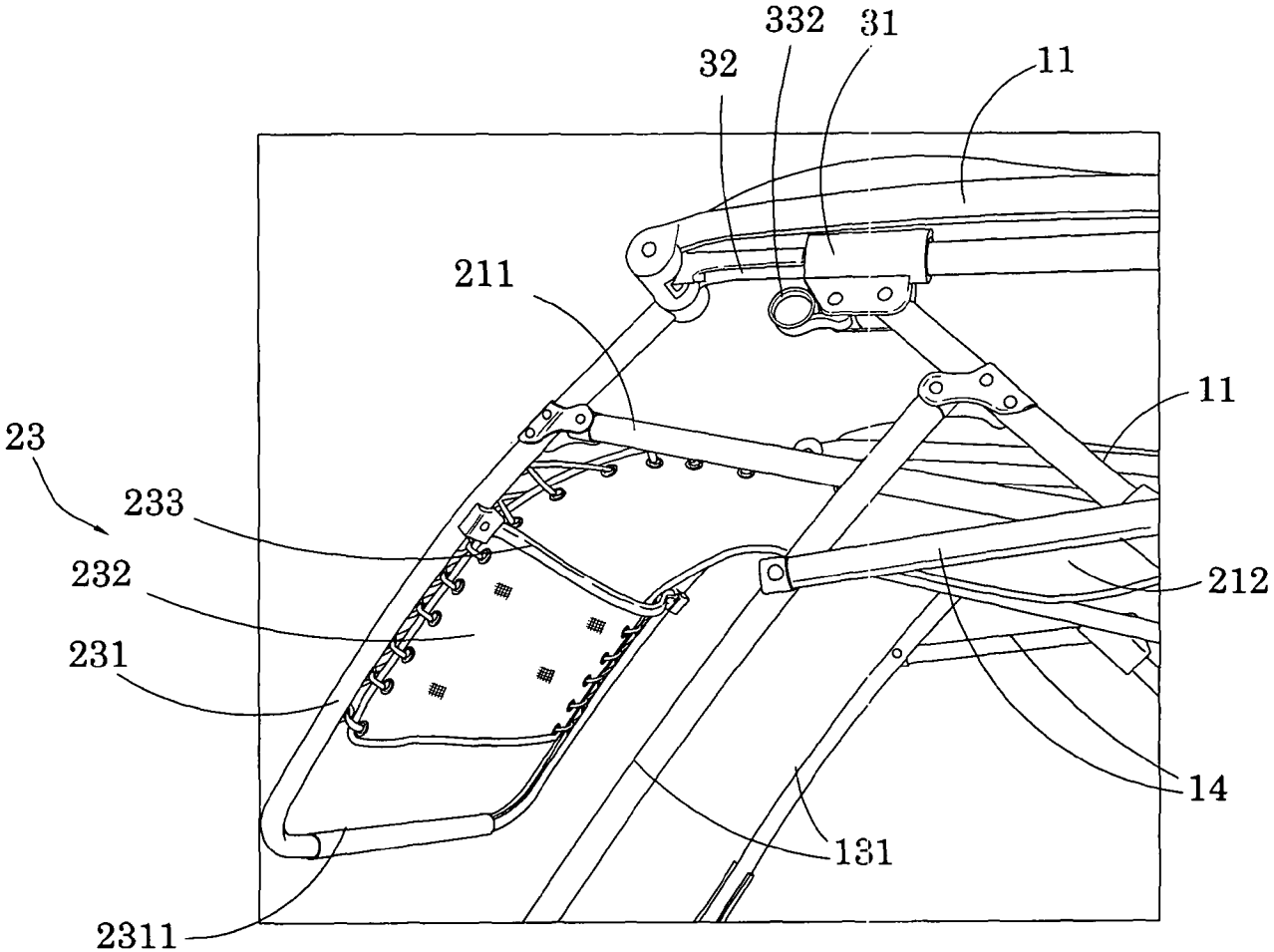
FIG. 7 is a perspective view of the leg supporting frame according to the above preferred embodiment of the present invention.

As shown in FIG. 7, the leg supporting frame 23 comprises a U-shaped leg arm 231 defining two side portions and a lower cross bar 2311, and a leg panel 232 mounting to the leg arm 231, wherein two ends of the leg arm 231 are extended upwardly. The two ends of the leg arm 231 are pivotally coupled with two front ends of the arm rests 11 respectively. The two ends of the seat arm 211 are pivotally coupled with the two side portions of the leg arm 231 respectively. Accordingly, the leg panel 232 comprises a leg fabric panel mounted between the two side portions of the leg arm 231 for supporting the user's legs at the leg panel 232. The leg panel 232 is integrally extended from the seat panel 221. In other words, the seat panel 221, the back panel 222, and the leg panel 232 are integrally formed to form a one piece fabric panel.

The leg supporting frame 23 further comprises a leg reinforcing arm 233 having two ends coupled with the side portions of the leg arm 231 at a position underneath the leg panel 232 to reinforce the strength of the leg panel 232 and to substantially support the feet of the user.

According to the preferred embodiment, the recliner is adapted to fold between the unfolded position as shown in FIG. 1 and the folded position as shown in FIG. 2. When the user sits on the recliner, the user is able to selectively adjust the inclination angle between the seat supporting frame 21 and the back supporting frame 22 while the leg supporting frame 23 is correspondingly fold with respect to the seat supporting frame 21 so as to self adjust the corresponding positions of the seat panel 221, the back panel 222, and the leg panel 232 to support the user's body.

As shown in FIG. 3, when the user sits on the recliner at the upright position, the user is able to recline the back supporting frame 22 by applying a mild upward pushing force at the leg arm 231. In other words, the user is able to put the feet at the lower cross bar 2311 of the leg supporting frame 23 and to exert with a mild force for pushing the lower cross bar 2311 upward. At the same time, the user is able to apply a mild pushing force at the back supporting frame 22 by the body of the user to pivotally move the back supporting frame 22 backward so as to increase the inclination angle between the seat supporting frame 21 and the back supporting frame 22. Therefore, the recliner of the present invention will be lowered the back supporting frame 22 and raised the leg supporting frame 23 for the user to lie on the recliner, as shown in FIG. 4.

Figure 8:
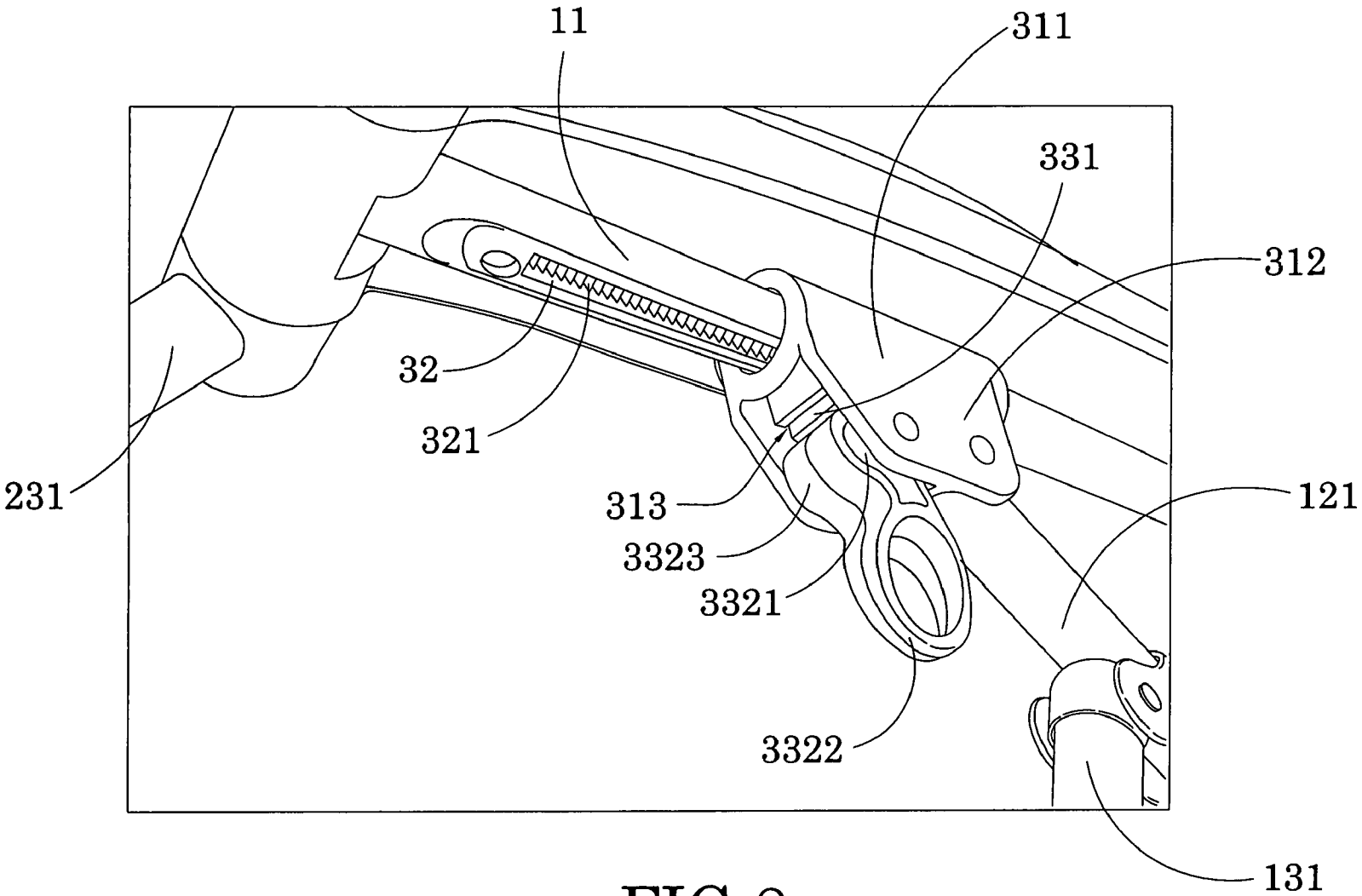
FIG. 8 is a perspective view of the locking mechanism according to the above preferred embodiment of the present invention.
Figure 9:
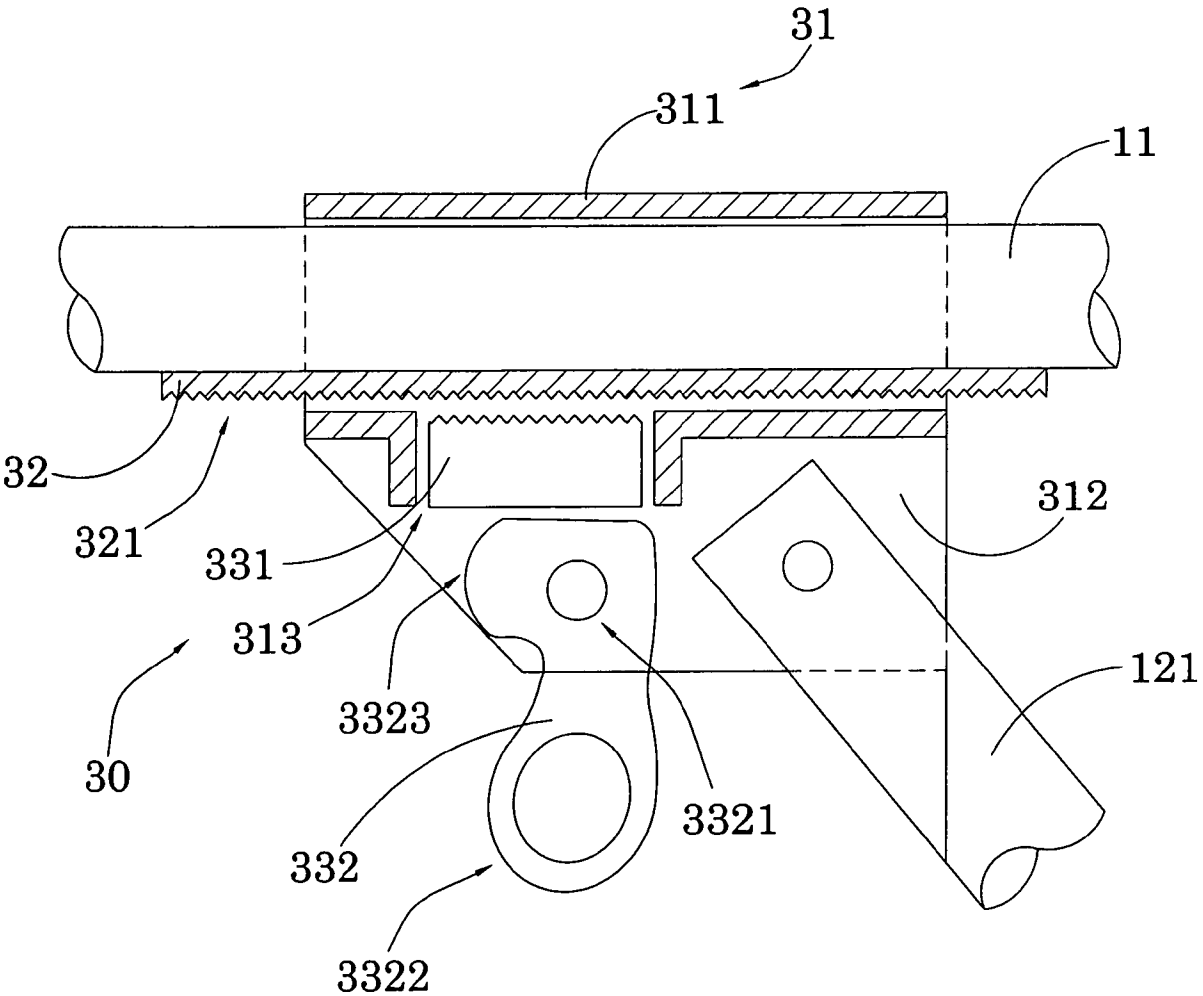
FIG. 9 is a sectional view of the locking mechanism at the unlocked position according to the above preferred embodiment of the present invention.

According to the preferred embodiment, the recliner further comprises a locking mechanism 30 for locking the chair frame 20 at the desired inclination angle between the seat panel 212 and the back panel 222. As shown in FIGS. 8 and 9, the locking mechanism 30 comprises two locking sliders 31 slidably coupled with the arm rests 11 of the folding frame 10, two locking rails 32 affixed to the arm rests 11 that the locking sliders 31 slide along the locking rails 32 respectively, and two operation lockers 33 coupled with the locking sliders 31 to lock up the locking sliders 31 along the locking rails 32 so as to lock up the chair frame 20 at the desired inclination angle.

Each of the locking sliders 31 comprises a tubular sliding member 311 slidably engaged with the respective arm rest 11 and two spaced apart pivot wall 312 downwardly extended from the sliding member 311 to pivotally couple with the respective end of the rear leg frame 12 between the pivot walls 312. The sliding member 311 further contains a locking slot 313 communicating the arm rest 11 with a space between the pivot walls 312.

Each of the locking rails 32 has two ends defining a predetermined length therebetween, wherein the locking slider 31 is slid at one end of the locking rail 32 when the folding frame 10 is folded at the folded position and is slid at another end of the locking rail 32 when the folding frame 10 is folded at the unfolded position. Accordingly, each of the locking rails 32 further has a teething surface 321 extended from one end to another end.

Each of the operation lockers 33 comprises an engaging member 331 slidably mounted at the respective locking slot 313 and a pivot handle 332 pivotally coupled with the respective locking slider 31 to move the engaging member 331 to engage with the respective locking rail 32. Accordingly, when the pivot handle 332 is pivotally moved to drive the engaging member 331 engaging with the locking rail 32, the arm rest 11 is locked in position with respect to the respective upper end of the rear leg frame 12. When the pivot handle 322 is pivotally moved to release the engaging member 331 from the locking rail 32, the arm rest 11 is allowed to slide freely with respect to the respective upper end of the rear leg frame 12.

Each of the engaging members 331 has a teething end facing towards the teething surface 321 of the locking rail 32 wherein when the teething end of the engaging member 331 is engaged with the teething surface 321 of the locking rail 32, the locking slider 31 is locked along the locking rail 32 between the two ends thereof.

Each of the pivot handles 332 has a coupling end 3321 pivotally coupled between the pivot walls 312 of the respective locking slider 31 and a driving end 3322 arranged when the driving end 3322 is pivotally lifted up towards the respective arm rest 11, the engaging member 331 is pushed upwardly by the pivot handle 332 until the teething end of the engaging member 331 is engaged with the teething surface 321 of the locking rail 32. Each of the pivot handles 332 further has a flat retaining shoulder 3323 slidably engaged with a flat bottom side of the engaging member 331 to hold the pivot handle 332 in position when the pivot handle 332 is upwardly folded so as to ensure the teething end of the engaging member 331 being engaged with the teething surface 321 of the locking rail 32. In other words, when the driving end 3322 of the pivot handle 332 is downwardly and pivotally moved away from the arm rest 11, the teething end of the engaging member 331 is downwardly dropped by its weight along the locking slot 313 to automatically disengaged with the teething surface 321 of the locking rail 32, so as to unlock the locking slider 31 with the locking rail 32.

Figure 10:
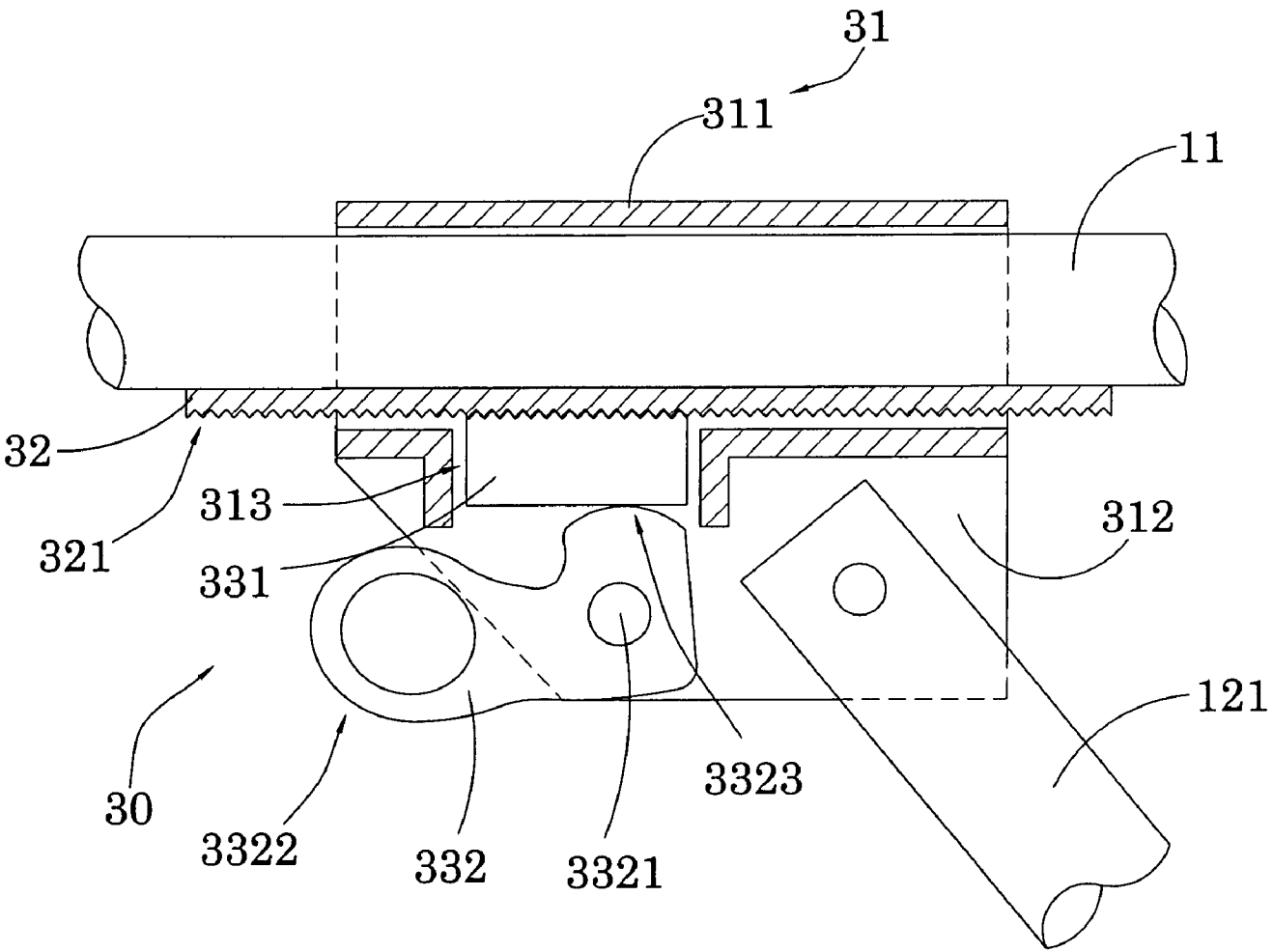
FIG. 10 is a sectional view of the locking mechanism at the locked position according to the above preferred embodiment of the present invention.

As shown in FIGS. 9 and 10, the driving end 3322 of each of the pivot handles 332 is formed in a ring shape for the user to pivotally fold between the locked position and the unlocked position by the fingers of the user.

According to the preferred embodiment, in order to selectively adjust the optimum inclination angle by the user, the user is able to put the feet at the lower cross bar 2311 of the leg frame 23 to exert the mild upward force thereat when the engaging members 331 are disengaged with the locking rails 32 respectively as shown in FIG. 9. Once the optimum inclination angle is set, the user is able to grip the driving ends 3322 of the pivot handles 332 by his or her fingers to pivotally and upwardly move the pivot handles 332 until the teething ends of the engaging members 331 are engaged with the teething surfaces 321 of the locking rails 32 respectively as shown in FIG. 10. Therefore, the chair frame 20 will be stayed at the desired inclination angle. It is worth to mention that the folding frame 10 is locked at the folded position via the locking mechanism 30.

According to the preferred embodiment, the locking mechanism 30 is provided at the bottom side of each of the arm rests 11 such that when the user sits on the chair frame 20 at a position the arms of the user rest on the arm rests 11, the user is able to tightly grip at the arm rests 11 by his or her hands to lock and unlock the locking mechanism 30 by the index fingers of the user. Therefore, once the user grips at the arm rests 11, the user is able to totally control the folding movement of the chair frame 20, including the movements of the seat supporting frame 21, the back supporting frame 22, and the leg supporting frame 23, to selectively adjust the inclination angle of the chair frame 20.

It is worth to mention that when the recliner is selectively adjusted its inclination angle, the arm rests 11 are slid corresponding to the back supporting frame 22 such that the user is able to grip at the arm rests 11 and to lie down on the back supporting frame 22 at the same time. Therefore, the sliding movement of the recliner is designed with respect to the body movement of the user.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A recliner, comprising:

a folding frame which comprises a rear leg frame, a front leg frame pivotally coupled with said rear leg frame, and two arm rests slidably coupled with two upper ends of said rear leg frame respectively;

a chair frame, which is movably coupled with said folding frame, comprising a seat supporting frame, a back supporting frame, and a leg supporting frame, wherein an inclination angle of said chair frame is selectively adjusted when said arm rests are slid at said upper ends of said rear leg frame; and a locking mechanism for locking up said inclination angle of said chair frame, wherein said locking mechanism comprises:

two locking sliders slidably coupled with said arm rests respectively, wherein each of said locking sliders has a locking slot and two spaced apart pivot walls that extend downwardly and generally parallel to said arm rests;

two locking rails affixed at bottom sides of said arm rests such that said locking sliders slide along said locking rails respectively, wherein each of said locking rails has a bottom teething surface; and two operation lockers coupled with said locking sliders respectively, wherein each of said operation lockers comprises an engaging member and a pivot handle, wherein said engaging member is disposed at said locking slot of said respective locking slider, wherein said engaging member has a teething end facing towards said teething surface of said respective locking rail, wherein said pivot handle is pivotally coupled with said locking slider between said two spaced apart pivot walls for rotation in a plane generally parallel to the arm rest to lock up said engaging member with said locking rail, wherein when said pivot handle is pivotally and upwardly moved to drive said teething end of said engaging member engaging with said teething surface of said respective locking rail, said arm rest is locked in position with respect to said respective upper end of said rear leg frame, wherein when said pivot handle is pivotally and downwardly moved to release an engagement between said teething end of said engaging member and said teething surface of said respective locking rail, said arm rest is allowed to slide freely with respect to said respective upper end of said rear leg frame.

2. The recliner, as recited in claim 1, wherein said engaging member is downwardly dropped by its weight in said respective locking slot to disengage said teething end of said engaging member with said teething surface of said respective locking rail when said pivot handle is pivotally and downwardly moved, so as to unlock said arm rest with respect to said respective upper end of said rear leg frame.

3. The recliner, as recited in claim 1, wherein each of said locking sliders comprises a tubular sliding member slidably engaged with said respective arm rest and two spaced apart pivot walls downwardly extended from said sliding member, wherein said upper end of said rear leg frame is pivotally coupled between said pivot walls of said respective locking sliders, wherein said locking slot is formed at said sliding member at a position between said two pivot walls.

4. The recliner, as recited in claim 2, wherein each of said locking sliders comprises a tubular sliding member slidably engaged with said respective arm rest and two spaced apart pivot walls downwardly extended from said sliding member, wherein said upper end of said rear leg frame is pivotally coupled between said pivot walls of said respective locking sliders, wherein said locking slot is formed at said sliding member at a position between said two pivot walls.

5. The recliner, as recited in claim 3, wherein each of said pivot handles has a coupling end pivotally coupled between said pivot walls of said respective locking slider and a driving end arranged when said driving end is pivotally lifted up, said engaging member is pushed upwardly until said teething end of said engaging member is engaged with said teething surface of said locking rail.

6. The recliner, as recited in claim 4, wherein each of said pivot handles has a coupling end pivotally coupled between said pivot walls of said respective locking slider and a driving end arranged when said driving end is pivotally lifted up, said engaging member is pushed upwardly until said teething end of said engaging member is engaged with said teething surface of said locking rail.

7. The recliner, as recited in claim 5, wherein each of said pivot handles further has a flat retaining shoulder slidably engaged with a flat bottom side of said engaging member to hold said pivot handle in position when said pivot handle is upwardly folded so as to ensure said teething end of said engaging member is engaged with said teething surface of said locking rail.

8. The recliner, as recited in claim 6, wherein each of said pivot handles further has a flat retaining shoulder slidably engaged with a flat bottom side of said engaging member to hold said pivot handle in position when said pivot handle is upwardly folded so as to ensure said teething end of said engaging member is engaged with said teething surface of said locking rail.

9. The recliner, as recited in claim 7, wherein said driving end of each of said pivot handles is formed in a ring shape for a user pivotally operating said pivot handles by fingers of the user while hands of the user grip at said arm rests to stably control a folding movement of said chair frame.

10. The recliner, as recited in claim 8, wherein said driving end of each of said pivot handles is formed in a ring shape for a user pivotally operating said pivot handles by fingers of the user while hands of the user grip at said arm rests to stably control a folding movement of said chair frame.

11. The recliner, as recited in claim 1, wherein said folding frame further comprises two retention arms, wherein each of said retention arms has a pivot end pivotally coupled with a front supporting leg of said front leg frame and a sliding end slidably coupled with a rear supporting leg of said rear leg frame for limiting a usage angle between said front and rear leg frames by a length of each of said retention arms, wherein said sliding ends of said retention arms are slidably coupled with said rear supporting legs of said rear leg frame via two sliding joints respectively, wherein each of said sliding joints has a tubular sleeve, wherein said respective rear supporting leg is slidably coupled with said tubular sleeve, wherein said retention arm is pivotally coupled with said tubular sleeve, wherein said folding frame further comprises two stoppers mounted at said rear supporting legs respectively at a position above said sliding joints such that when said sliding joints upwardly slide along said rear supporting legs respectively, said sliding joints are blocked by said stoppers respectively to block a further sliding movement of said sliding joints.

12. The recliner, as recited in claim 10, wherein said folding frame further comprises two retention arms, wherein each of said retention arms has a pivot end pivotally coupled with a front supporting leg of said front leg frame and a sliding end slidably coupled with a rear supporting leg of said rear leg frame for limiting a usage angle between said front and rear leg frames by a length of each of said retention arms, wherein said sliding ends of said retention arms are slidably coupled with said rear supporting legs of said rear leg frame via two sliding joints respectively, wherein each of said sliding joints has a tubular sleeve, wherein said respective rear supporting leg is slidably coupled with said tubular sleeve, wherein said retention arm is pivotally coupled with said tubular sleeve, wherein said folding frame further comprises two stoppers mounted at said rear supporting legs respectively at a position above said sliding joints such that when said sliding joints upwardly slide along said rear supporting legs respectively, said sliding joints are blocked by said stoppers respectively to block a further sliding movement of said sliding joints.

13. The recliner, as recited in claim 11, wherein said seat supporting frame comprises a U-shaped seat arm and a seat panel mounted to said seat arm, wherein two side portions of said seat arm are pivotally coupled with said sliding joints respectively such that when said sliding joints are slid along said rear supporting legs, said seat arm is correspondingly folded in a pivotally movable manner.

14. The recliner, as recited in claim 12, wherein said seat supporting frame comprises a U-shaped seat arm and a seat panel mounted to said seat arm, wherein two side portions of said seat arm are pivotally coupled with said sliding joints respectively such that when said sliding joints are slid along said rear supporting legs, said seat arm is correspondingly folded in a pivotally movable manner.

15. The recliner, as recited in claim 13, wherein said back supporting frame comprises an inverse U-shaped back arm and a back panel mounted to said back arm, wherein two ends of said back arm are pivotally coupled with said side portions of the seat arm respectively such that said back supporting frame is pivotally coupled with said seat supporting frame to selectively adjust said inclination angle between said seat supporting frame and said supporting back frame.

16. The recliner, as recited in claim 14, wherein said back supporting frame comprises an inverse U-shaped back arm and a back panel mounted to said back arm, wherein two ends of said back arm are pivotally coupled with said side portions of the seat arm respectively such that said back supporting frame is pivotally coupled with said seat supporting frame to selectively adjust said inclination angle between said seat supporting frame and said supporting back frame.

17. The recliner, as recited in claim 15, wherein said leg supporting frame comprises a U-shaped leg arm defining two side portions and a lower cross bar, and a leg panel mounting to said leg arm, wherein two ends of said leg arm are pivotally coupled with two front ends of said arm rests respectively and said two ends of said seat arm are pivotally coupled with said two side portions of said leg arm respectively.

18. The recliner, as recited in claim 16, wherein said leg supporting frame comprises a U-shaped leg arm defining two side portions and a lower cross bar, and a leg panel mounting to said leg arm, wherein two ends of said leg arm are pivotally coupled with two front ends of said arm rests respectively and said two ends of said seat arm are pivotally coupled with said two side portions of said leg arm respectively.

19. The recliner, as recited in claim 17, wherein said seat panel, said back panel, and said leg panel are integrally formed to form a one piece fabric panel for the user lying thereat, wherein said leg supporting frame further comprises a leg reinforcing arm extending between said two side portions at a position underneath said leg panel.

20. The recliner, as recited in claim 18, wherein said seat panel, said back panel, and said leg panel are integrally formed to form a one piece fabric panel for the user lying thereat, wherein said leg supporting frame further comprises a leg reinforcing arm extending between said two side portions at a position underneath said leg panel.

* * * * *